United States Patent [19]

Hunsberger et al.

[11] 4,391,580

[45] Jul. 5, 1983

[54] LIQUID FUEL SUPPLY SYSTEM FOR AN ATOMIZATION BURNER NOZZLE

[75] Inventors: Dale L. Hunsberger; Frank L. Harwath, both of Rockford, Ill.

[73] Assignee: Sundstrand Corporation, Rockford, Ill.

[21] Appl. No.: 213,923

[22] Filed: Dec. 8, 1980

[51] Int. Cl.[3] ..... F23C 11/00; F04C 29/08

[52] U.S. Cl. ..... 431/1; 239/101; 417/440; 418/15; 418/183

[58] Field of Search ..... 431/1; 137/624.13, 624.14; 418/15, 170, 183; 417/440; 239/99, 101

[56] References Cited

U.S. PATENT DOCUMENTS

| | | | |
|---|---|---|---|
| 2,464,698 | 3/1949 | Logan | 431/265 |
| 4,255,093 | 3/1981 | Erikson | 417/310 |

FOREIGN PATENT DOCUMENTS

| | | |
|---|---|---|
| 2124006 | 6/1978 | Fed. Rep. of Germany . |
| 2353019 | 12/1977 | France . |
| 2377006 | 8/1978 | France . |

*Primary Examiner*—Samuel Scott
*Assistant Examiner*—Lee E. Barrett
*Attorney, Agent, or Firm*—Wood, Dalton, Phillips, Mason & Rowe

[57] ABSTRACT

A system for supplying fuel to an atomization fuel oil burner nozzle from a fuel pump at a rate less than that rated for the nozzle for burning of less fuel while achieving good combustion. The fuel is delivered to the nozzle at a pulsing frequency which is dynamically matched to intermittent pressure pulses within the fuel pump to create resonant pressure peaks at the nozzle. The fuel pump creates a pressure pulse each time a tooth of one gear of the pump makes full penetration into the space between a pair of teeth of a coacting rotatable ring gear. Rotatable valving structure, including gear ports in the rotatable ring gear pulses fluid flow to the nozzle by alternately connecting a fluid outlet of the pump to either a pressure port within the pump at the time of a pressure pulse or to the fuel pump inlet with the pressure peak of the pulsed flow being phased together with said pressure pulse.

15 Claims, 10 Drawing Figures

LIQUID FUEL SUPPLY SYSTEM FOR AN ATOMIZATION BURNER NOZZLE

BACKGROUND OF THE INVENTION

This invention relates to a liquid fuel supply system for an atomization burner nozzle wherein the liquid fuel is supplied at a pulsing pressure characterized by supplying the nozzle with fuel at a continually-varying positive gauge pressure for a first period of time and interrupting the fuel supply during a second period of time. The pulsation pressure peaks are phased together with the pressure peaks of the natural pulsations occurring within the fuel pump structure to enhance the positive values of the pulsation pressure peaks and pump pressure peaks during said first period of time and the negative values of the pressure during said second period of time as well as the pressure rates of rise and fall, respectively, so as to minimize the time when positive sub-atomization fuel pressures are present at the atomizing nozzle.

Properly sized fuel oil fired heating systems for maximum efficiency are difficult to obtain for certain smaller-sized heating requirements, such as mobile homes, apartments, and small homes as well as larger dwellings during less severe heating seasons because of plugging problems with high pressure atomization nozzles. If the nozzle is sized sufficiently small for reduced delivery of fuel from the nozzle, it becomes subject to plugging by particulate material. Other methods of obtaining proper fuel flow rates, such as low pressure air-oil nozzles and sonic atomizers require other modifications to the heating system which add significant cost.

One system developed for delivering less than normal fuel through a nozzle is disclosed in Robert W. Erikson application Ser. No. 023,428, filed Mar. 23, 1979, now U.S. Pat. No. 4,255,093 and owned by the assignee of this application. In the structure of the Erikson application, the high pressure discharge from the pumping elements of the fuel pump is directed through a metering orifice open at timed intervals to provide a relatively low volume of flow to the burner nozzle, while avoiding the clogging problem.

A more recent system is that disclosed in James Harvey Moore Meyer application Ser. No. 165,565, filed July 3, 1980, and owned by the assignee of this application. In the method and structure disclosed in the Meyer application, the fuel is delivered to an atomization nozzle at a pulsing frequency which is dynamically matched to intermittent pressure pulses within the fuel pump to create resonant pressure peaks at the nozzle above normal regulated pressure with intermittent negative values of pressure to result in reduced flow of fuel through the nozzle.

It is also known in the art to supply fuel to an atomization nozzle from a fuel pump supplying fuel at a constant pressure and interrupting the delivery of fuel to the nozzle periodically to reduce the total rate of flow per unit of time through the nozzle by means of a rotatable member which blocks communication between the fuel pump and nozzle and during the blocked interval connects the nozzle to the pump inlet or source of fuel. Such a system does not provide a good workable system with high combustion efficiency at the nozzle.

SUMMARY OF THE INVENTION

This invention relates to a system for delivery of liquid fuel to an atomization fuel oil burner nozzle by connecting the nozzle intermittently to either a source of fuel under pressure or pump inlet and the connection to the source of pressure being operable to phase together the pressure peaks of the natural pulsations occurring within the pump and the pressure peaks of the periodic pulsations of the connection between the pump and nozzle. This enhances the positive values of the pressure peaks when the nozzle is connected to the pressure source and the negative values of the pressure during the time period of connection to the pump inlet.

In carrying out the foregoing, a fuel pump has a fluid inlet and a fluid outlet with a pressure port and an inlet port, rotatable pump gears which pump fuel from the inlet port to the pressure port with a pressure pulse created each time a tooth of one gear makes full penetration into the space between a pair of teeth on the other gear, timing ports connected to the fluid outlet and rotatable valve means including gear ports in one of said rotatable gears for periodically connecting either the pressure port or the inlet port to the pump fluid outlet and with phasing of the intermittently-connected parts to have the pressure peak of the pulsed flow to the pump fluid outlet occurring at the time of the pressure pulse.

Additional objects of the invention are to provide a liquid fuel supply system wherein: the fuel flow rate supplied to the nozzle can be varied by varying the time relation between the time in which the pulsed flow is operative and the time in which the nozzle is connected to the fuel source by varying the rotating speed of the pump; the feed relation between the pump and the combustion air supply mechanism is maintained whereby the ratio of fuel flow rate to airflow rate remains such that good combustion of fuel results at any of the preferred rotating speeds of the pump; and the speed of the pump can be varied either manually or by a system which senses the fuel flow requirement.

DESCRIPTION OF THE PREFERRED EMBODIMENT

Figure 1:
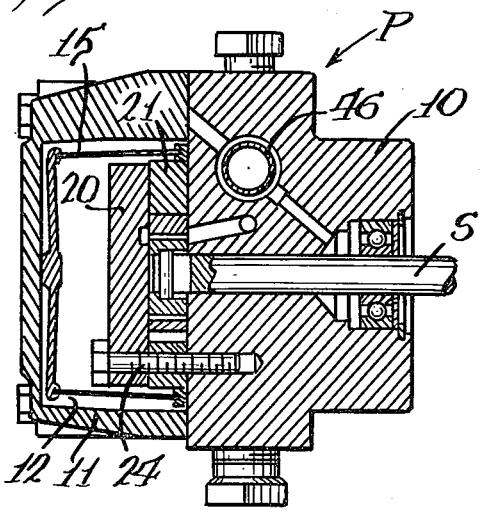
FIG. 1 is a cross sectional view of a gear pump embodying the novel features of the present invention.
Figure 2:
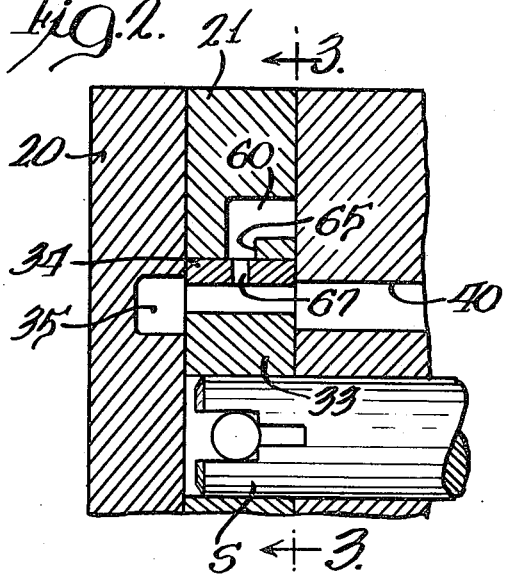
FIG. 2 is an enlarged fragmentary section of a portion of the pump shown in FIG. 1 with the pump shaft in a different rotative position.

The liquid fuel supply system includes a fuel pump P, shown in FIGS. 1 to 5, wherein a pump housing includes a casting 10 and a cover 11 suitably secured thereto and having a reservoir 12 which, through a strainer 15, can supply fuel, such as oil, to pump elements associated with additional parts of the housing including a port plate 20 and a plate 21 surrounding the pumping elements and which are suitably attached to the casting 10 as by means 24.

The pump has a fluid inlet 25 which, through a passage 26, supplies a kidney-shaped inlet port 27 in the port plate 20. The pump has a pair of fluid outlets, with there being a fluid outlet 30 for pulsed fuel flow and a fluid outlet 31 for continuous fuel flow. A return port 32 connects to a fuel tank having a source of fuel for the fluid inlet 25.

The pump includes a pair of pumping elements, in the form of rotatable gears, located within an opening of the plate member 21. There is an externally-toothed inner gear 33 mounted on a shaft S for rotation and a surrounding internally-toothed ring gear 34 which together rotate between the fluid inlet port 27 and an arcuate kidney-shaped pressure port 35 in association with a crescent member 36 deliver pressurized fluid to the pressure port 35 in the port plate 20. It is a characteristic of such a pump that there is a pressure pulse each time a tooth 37 of the inner gear makes full penetration into the space between a pair of teeth 38 of the ring gear.

Figure 5:
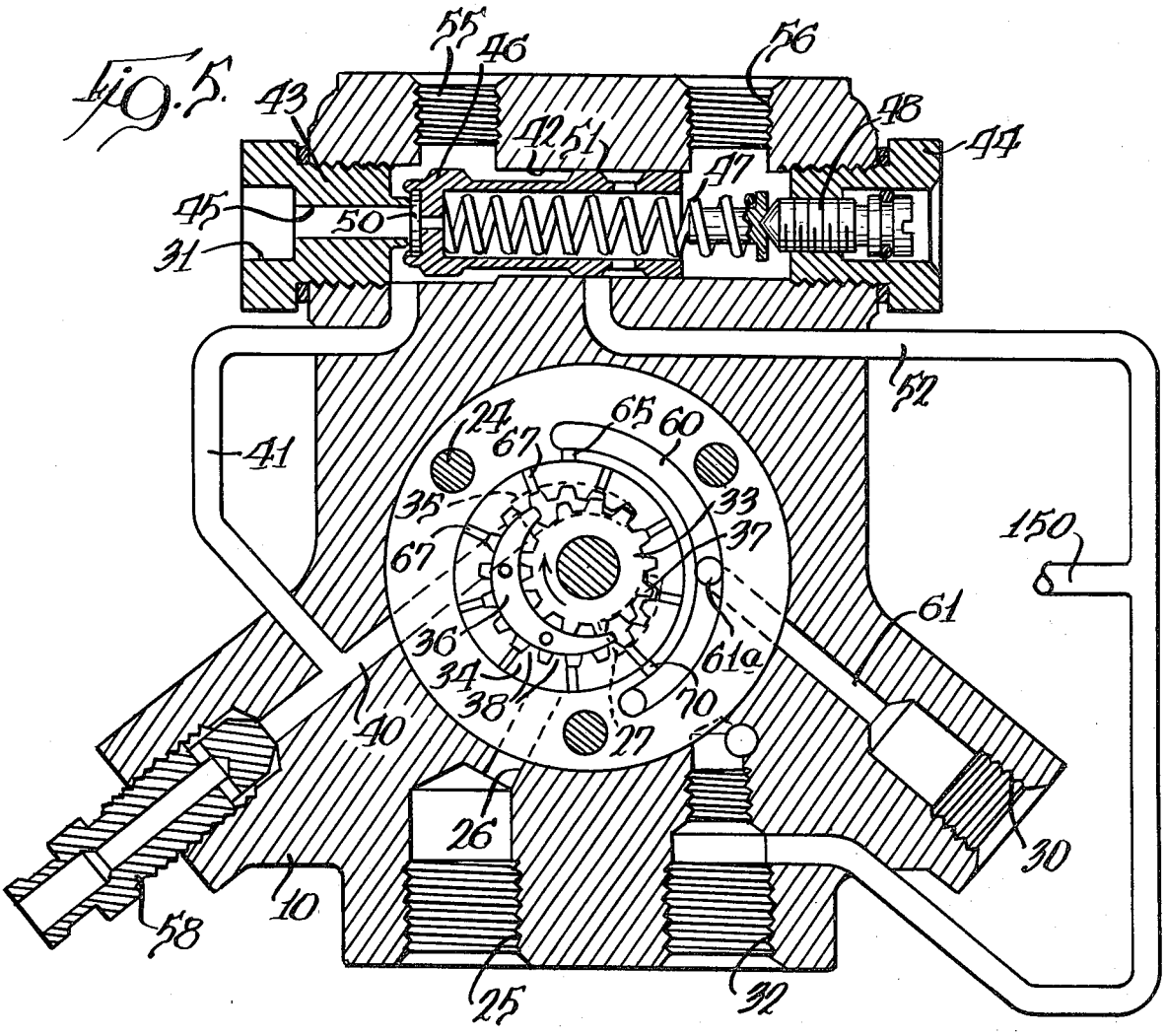
FIG. 5 is a schematic illustration of the pump shown in FIG. 1.

The pressure port 35 communicates with the fluid outlet 31 of the pump through housing passages 40 and 41, shown diagrammatically in FIG. 5, with the passage 41 leading to a bore 42 in which a pressure-regulating valve is mounted. The ends of the bore 42 are closed by a pair of threaded caps 43 and 44. The threaded cap 43 has a passage 45 leading to the fluid outlet 31 and has an end forming a valve seat against which a seat member 50 of a pressure-regulating valve member 46 is urged by a spring 47 positioned within the interior of the valve member and abutting against a surface thereof and its opposite end abutting against a threaded adjustment member 48 carried in the end cap 44. The adjustment of the spring 47 determines the pressure of the fuel delivered through the fluid outlet 31. The valve member 46 remains closed until the pressure of the fuel delivered from the pressure port 35 is sufficient to overcome the force of the spring and then the valve member moves to the right as viewed in FIG. 5 to move the seat member 50 away from the valve seat and permit flow to the fluid outlet. The pressure is regulated by an annular land 51 on the exterior of the valve member which coacts with a fluid passage 52 for delivery of fuel oil back to the return port 32. The bore 42 has a pair of passages 55 and 56 which are capped and not used. An end of the passage 40 leading to the pressure-regulating valve has a bleed valve 58 operable in a known manner for bleeding the pressure line. A line 150 connects a pump seal chamber to the fluid passage 52 for return of leakage oil to the return port.

The flow to the fluid outlet 30 is pulsed flow which is achieved by intermittent pulsing of fuel under pressure from the pressure port 35 to the outlet. The structure for accomplishing this includes an elongate arcuate passage 60 in the plate 21 of the pump housing which at least partially spans the arcuate inlet port 27 and the arcuate pressure port 35 and lies at a greater distance from the axis of rotation of the shaft S and communicates with the fluid outlet 30 by means of a passage 61.

The arcuate passage 60 communicates with the passage 61 extending to the fluid outlet 30 through a passage **61*a* in the casting 10, indicated diagrammatically in FIG. 5**.

A discharge timing port 65, formed in the plate 21, extends inwardly from the arcuate passage 60 to connect the arcuate passage with the outer periphery of the ring gear 34. As the pump gears are rotated, the pressure port 35 intermittently communicates with the arcuate passage 60 through the discharge timing port 65, with this intermittent communication being accomplished by rotatable valve means in the form of gear ports formed in the ring gear 34 and extending radially outward from a radial location of overlap with the pressure port 35 and from the roots between certain pairs of teeth on the ring gear to the outer periphery of the ring gear. In the pump construction shown, there is a gear port 67 extending radially outward from every other root of the ring gear which results in there being a relation of one gear port for every other pressure pulse caused by the full penetration of a tooth 37 on the inner gear 33.

Figure 3:
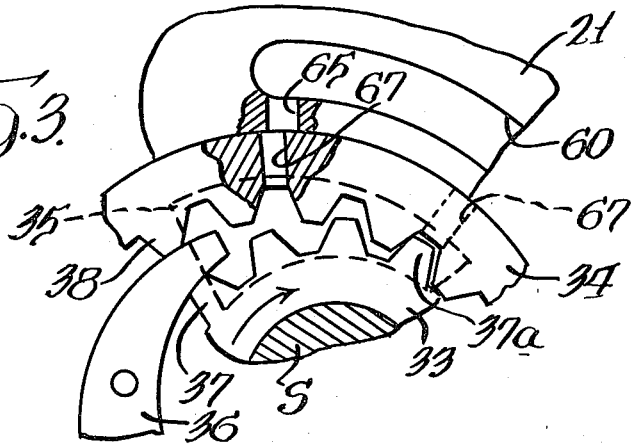
FIG. 3 is a sectional view, taken generally along the line 3—3 in FIG. 2.

Referring particularly to FIG. 3, the relation of pump structure shortly prior to a pressure pulse within the pump gears is shown wherein a gear port 67 is communicating with the discharge timing port 65 to connect the pressure port 35 to the arcuate passage 60. It will be noted that there is a gear port 67 that has moved beyond the discharge timing port 65 and which communicates with the space between teeth which will shortly, beyond the point shown, be in full penetration. The latter gear port is inactive. The gear port 67 shown communicating with the discharge timing port 65 has a lesser width than the discharge timing port and these last two ports are related whereby the trailing end of the gear port 67 will move past the trailing end of the discharge timing port 65 immediately after the pressure pulse created by the full penetration of the gear tooth **37*a* into the space between a pair of gear teeth on the ring gear 34. The pressure peaks of the main fuel pump pulsation created by the communication of a gear port 67 with the discharge timing port 65 occurs at the last point in time during which the gear port 67 communicates with the discharge timing port 65. The main fuel pump pulsation is phased together with the pressure peak of the natural pulsation occurring within the pump gears to enhance the positive values of the pressure peaks of the fuel delivered from the fluid outlet 30. There is a fixed frequency relation of the pressure peaks because of the fixed rotation of the gear ports by their formation in the ring gear 34**.

Figure 4:
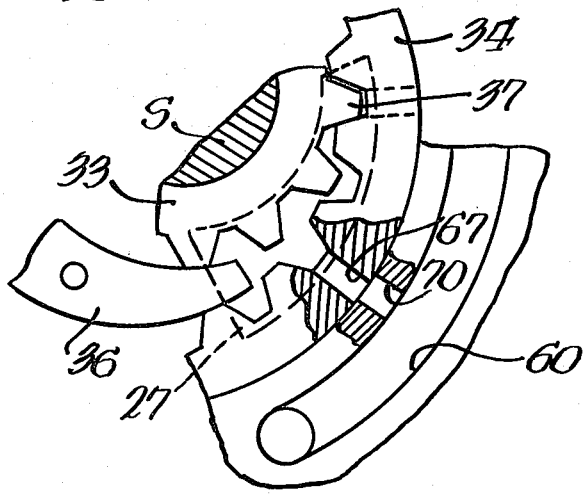
FIG. 4 is a sectional view, similar to FIG. 3 taken at a different location within the gear pump.

In addition to the positive pressure pulses, there are time intervals of negative pressure in the fluid line leading to the nozzle because of interconnection of the fluid outlet 30 to the inlet side of the pump and with this structure being shown generally in FIGS. 4 and 5. The arcuate passage 60 has a dump timing port 70 extending inwardly therefrom which communicates with the outer periphery of the ring gear whereby there is periodic communication through a gear port 67 with the fluid inlet port 27. As seen in FIG. 5, the discharge timing port 65 and the dump timing port 70 are oriented whereby both of said ports are never operative at the same time.

Figure 6:
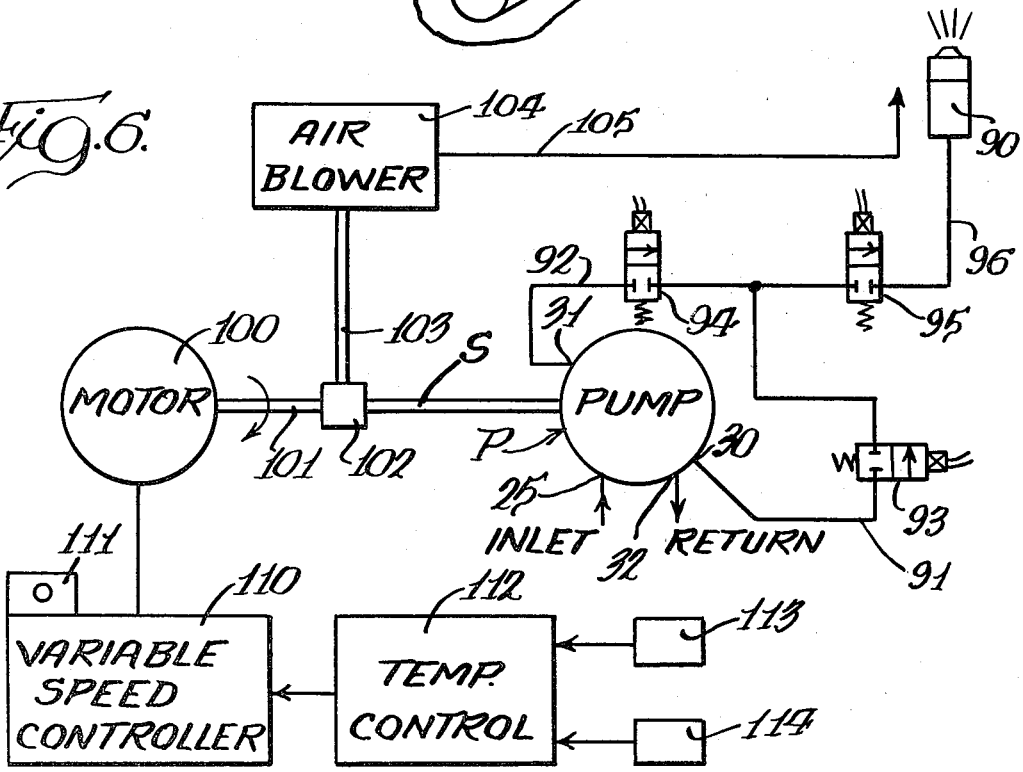
FIG. 6 is a diagrammatic view of the liquid fuel supply system and associated structure and control therefor.

The liquid fuel supply system is shown in operative relation with other structure in the diagram of FIG. 6. The pump P has the fluid outlets 30 and 31 connected to an atomization burner nozzle 90 by respective fluid lines 91 and 92 each of which have a selectively operable shutoff valve 93 and 94, respectively, and which lead to a selectively operable system shutoff valve 95 having an outlet line 96 extending to the nozzle. If pulsed flow is desired, the valves 93 and 95 are opened and the valve 94 is closed. If continuous flow is desired, the valves 94 and 95 are opened and valve 93 is closed. The pump P is driven by a motor 100 having an output shaft 101 connected to the pump shaft S through a gearbox 102 which has an output shaft 103 for rotating an air blower 104 having an air supply line 105 extending into association with the nozzle 90. Alternatively, the air blower can be mounted on shaft 101. A variable speed controller 110 for the motor 100 provides for varying the rotating speed of the fuel pump, either by means of a manual mechanical switch 111 or by a temperature control 112 which responds automatically to the fuel flow requirement. The temperature control 112 is a known system which can have inputs, as for example, from an outdoor thermostat 113 and an indoor thermostat 114 whereby the control 112 determines the setting of the variable speed controller 110 for a desired fuel flow.

Figure 8:
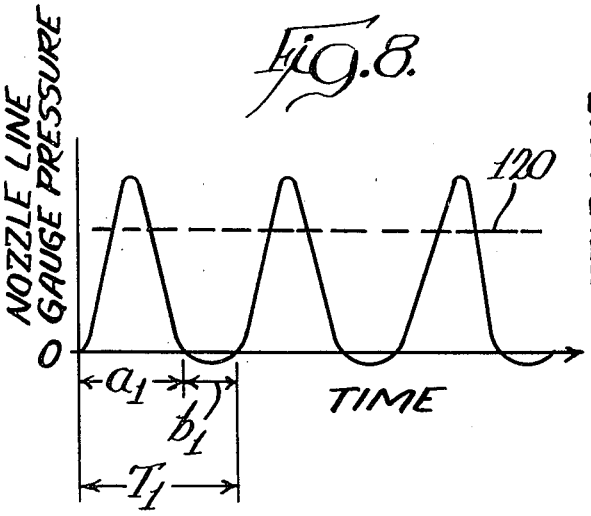
FIG. 8 is a graph plotting nozzle line gauge pressure against time at one speed of pump operation.
Figure 9:
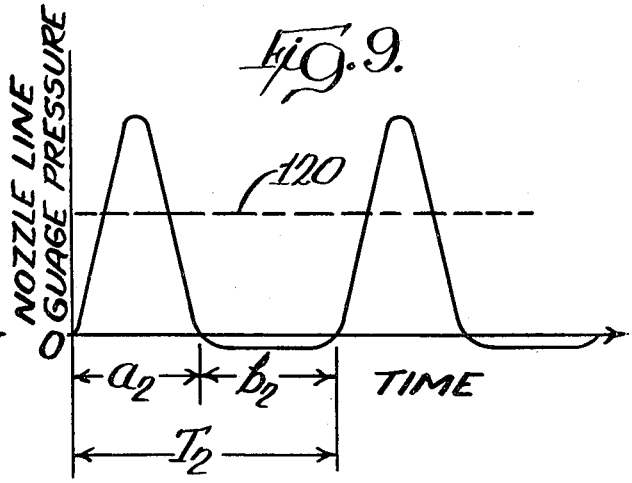
FIG. 9 is a graph, similar to FIG. 8, with the indicated characteristics shown at different speed of pump operation.

The liquid fuel supply system can supply different rates of pulsed fuel flow dependent upon the speed of operation of the pump. The variation in the pulsed flow resulting from different pump speeds is shown by comparing the graphs of FIGS. 8 and 9 wherein nozzle line gauge pressure is plotted against time and with the nozzle line gauge pressure which provides a good atomization level being indicated by a broken line 120. A fuel pump may normally operate between the speeds of 1400 and 3600 rpm's. The graph of FIG. 8 shows the operation, as for example, at approximately 3450 rpm wherein a cycle of pulsed flow is indicated by $T_1$ with that part of the cycle having positive gauge pressure being indicated by the interval $a_1$ and with the time occurrence of negative gauge pressure being indicated by the interval $b_1$. The graph of FIG. 9 shows operation at a lesser speed, such as approximately 1725 rpm's. The total cycle time period has increased approximately 100%, but, due to changes in dynamic restrictions to fluid flow in the fuel pump passages, the ratio of on-time $a_2$ to the cycle period $T_2$ is less than the ratio of on-time $a_1$ to cycle time $T_1$, therefore producing a lower fuel flow rate with the lower fuel pump speed.

The fuel pump disclosed herein provides a resonant system through use of rotatable valve means formed integrally with the pump elements, specifically the ring gear, whereby there is a frequency relation between the chopping of the pulses and the pressure pulses of the natural gear tooth pulsations. In the particular embodiment shown, there is one chopped pulse for every other pressure pulse caused by the inner gear tooth penetration to provide the resonant system.

Figure 7:
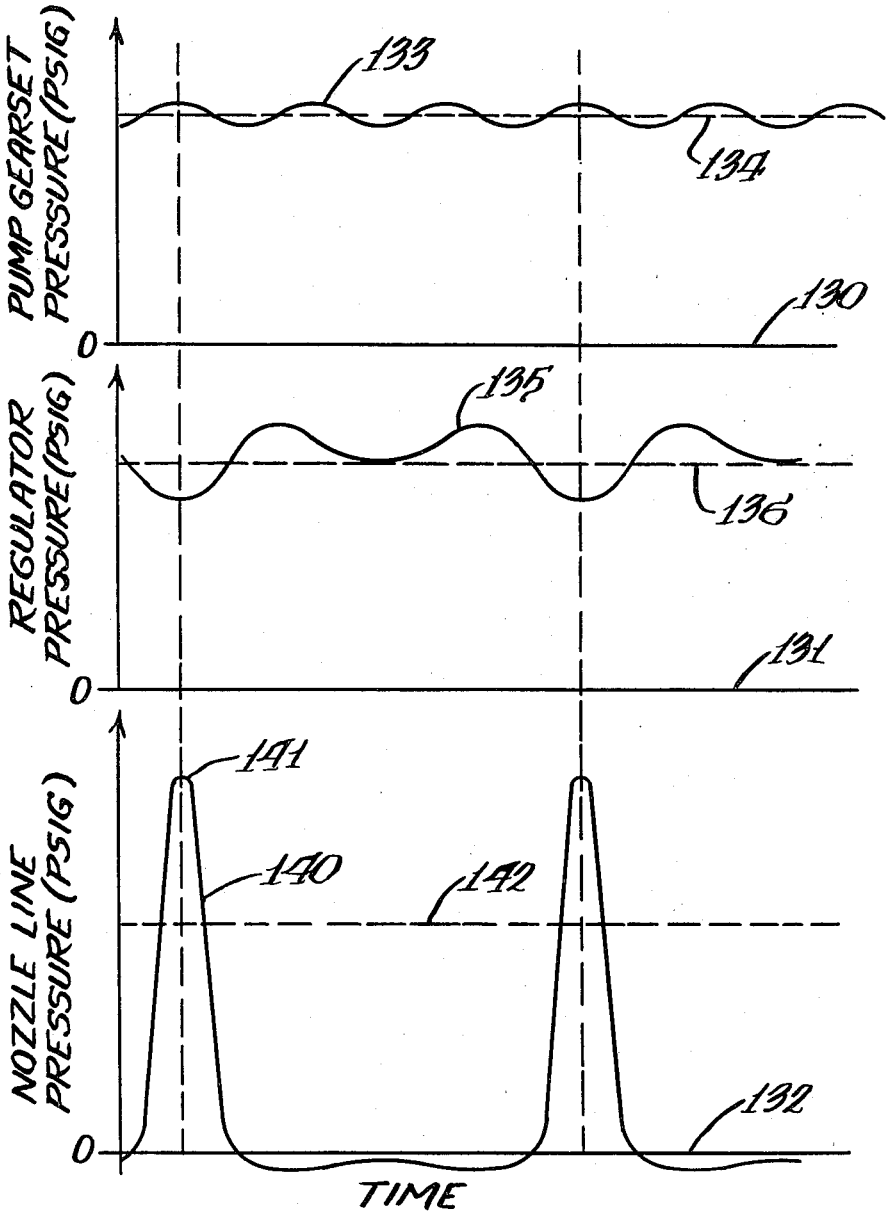
FIG. 7 is a graph showing three different pressure conditions with respect to time in one frequency relation.

The graph of FIG. 7 shows pressure pulses at various locations within the system and which are plotted with respect to time and with zero gauge pressure being indicated at the lines 130, 131 and 132. The graph represents three pressure conditions, with the uppermost portion of the graph showing the pump gear set pressure and, more particularly, the pressure pulses created by full mesh of a tooth 37 of the inner gear with the space between a pair of teeth in the ring gear. These pressure pulses are represented by the curve 133, which is shown to be a curve having values both above and below a broken line representing regulated pressure and with this line being identified at 134. The second curve 135, shown in relation to regulated pressure at 136, represents pressure at the pressure port 35 of the pump and is seen to have values both above and below regulated pressure and to be 180 degrees out of phase with the pressure pulses when the pressure port communicates with the discharge timing port 65. The third portion of the graph shows the pressure in the nozzle line 91 as represented by the curve 140 which has pressure peaks 141 in phase with the pressure pulses shown by the curve 133 and which are substantially above regulated pressure as represented by the line 142.

The curve 140 of the graph of FIG. 7 shows the peak pressure achieved by phasing the natural pump pressure peak pulsation with the peak of the main fuel pump pulsation created by communication with the discharge timing port 65. As soon as one of the gear ports 67 goes out of communication with the discharge timing port 65, the flow of fuel in the discharge passage 61 is stopped and, simultaneously, one of the gear ports 67 begins to communicate with the dump timing port 70 which allows high pressure fluid from the passage 61 to flow back into the fluid inlet 27. This results in the relatively steep curve 140 to minimize the time of positive pressure below regulated pressure and thus minimize the time below the regulated pressure line 142 in order to assure good atomization of the fuel oil.

Figure 10:
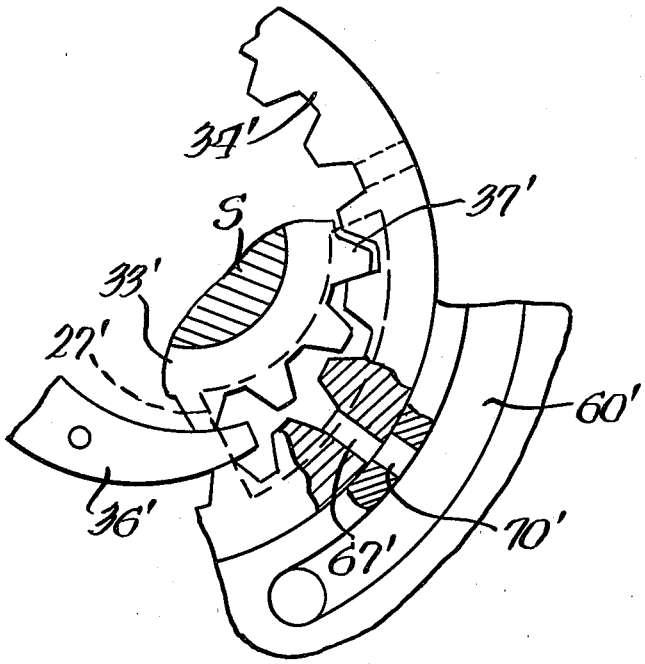
FIG. 10 is a sectional view similar to FIG. 4, showing an alternate embodiment of pump structure.

The graph of FIG. 7 illustrates a system wherein the chopped pulse occurs on every third pressure pulse as would occur with a gear port 67 extending from every third ring gear root, as shown in FIG. 10. The structure shown in FIG. 10 which is the same as that shown in FIGS. 1 through 5, is given the same reference numerals with a prime affixed thereto. In the structure disclosed, in FIGS. 1 through 5, the chopped pulse occurs on every other full mesh pressure pulse and thus establishes pressure conditions as shown in the graph of FIG. 3 of the previously mentioned Meyer's application, Ser. No. 165,565, and the disclosure thereof is incorporated herein by reference.

I claim:

1. A liquid fuel supply system for an atomization burner having a nozzle comprising, a fuel pump having a pair of rotatable gears for pumping fuel from a pump inlet port to a pressure port with a pressure pulse created each time a tooth of one gear makes full penetration into the space between a pair of teeth on the other gear, a passage in said pump, a fluid outlet from the pump connected to said passage and adapted for connection to said nozzle, and means for pulsing fluid flow to the nozzle by alternately connecting said passage to said pressure port at the time of a pressure pulse and to the fuel pump inlet port with the pressure peak of the pulsed flow being phased together with said pressure pulse.

2. A liquid fuel supply system for an atomization burner having a nozzle comprising, a fuel pump having a pair of rotatable gears for pumping fuel from a pump inlet port to a pressure port with a pressure pulse created each time a tooth of one gear makes full penetration into the space between a pair of teeth on the other gear, a passage in said pump, a fluid outlet from the pump connected to said passage and adapted for connection to said nozzle, and rotatable valve means for pulsing fluid flows to the nozzle by alternately connecting said passage to said pressure port at the time of a pressure pulse and to the fuel pump inlet port, said rotatable valve means including port means in one of said gears which by gear rotation connects the pressure port to said passage in a fixed frequency relation and with the pressure peak of the pulsed flow occurring at the time of said pressure pulses.

3. A system as defined in claim 2 including means operable at a variable speed for driving one of said rotatable gears, and means for varying the speed of the last-mentioned means to control the rate of fuel supplied to the nozzle without varying said fixed frequency relation.

4. A system as defined in claim 3 including a combustion air supply mechanism for supplying combustion air to said nozzle, and means for driving said mechanism at the same speed as said pump whereby air flow and fuel flow rates have a ratio for good fuel combustion.

5. A system as defined in claim 2 wherein said rotatable valve means is operable to connect every third pressure pulse to said nozzle.

6. A liquid fuel supply system for an atomization burner having a nozzle comprising, a fuel pump having a pair of rotatable gears for pumping fuel from a pump inlet to a pressure port with a pressure pulse created each time a tooth of one gear makes full penetration into the space between a pair of teeth on the other gear, a fluid outlet from the pump adapted for connection to said nozzle, and means including gear ports in one of said gears for pulsing fluid flow to the nozzle by alternately connecting said fluid outlet to either said pressure port or to the fuel pump inlet, said means having one operative position wherein the pressure port and fluid outlet are connected and another operative position wherein the pressure port is blocked from the fluid outlet and the fluid outlet is connected to the fuel pump inlet and being operable to connect the pressure port to said fluid outlet at the time of a pressure pulse and in a fixed frequency relation with said pressure pulses.

7. A system as defined in claim 6 wherein said pump has a pressure regulating valve communicating with said pressure port for establishing a regulated pressure for fuel delivered from said pressure port.

8. A system as defined in claim 6 wherein said pump is a crescent-gear type with one gear being externally-toothed and coacting with the other gear which is internally-toothed and the pump has a fluid inlet port arcuately spaced from said pressure port, an arcuate passage at least partially spanning said pressure port and fluid inlet port and lying radially outwardly thereof and communicating with the fluid outlet, and said gear ports extending radially through said internally-toothed gear for alternate periodic connection of the pressure and inlet ports to said passage.

9. A fuel pump for delivering pulsed fuel flow to a nozzle of an atomization burner comprising, a pump housing, a pair of rotatable gears which together rotate between an arcuate fluid inlet port and an arcuate pressure port and deliver pressurized fluid to the pressure port with a pressure pulse each time a tooth of one gear makes full penetration into the space between a pair of teeth of the other gear, a pump outlet, an elongate passage in said pump housing at least partially spanning said inlet and pressure ports and communicating with said pump outlet, a discharge timing port and a dump timing port in said pump housing connecting to said elongate passage, a series of gear ports formed in one of said gears, each gear port being located in said one gear whereby in one revolution of said one gear the gear port, at different times, periodically moves past said timing ports and connects the pressure port to the discharge timing port and the fluid inlet port to the dump timing port, said timing ports being positioned to have only one timing port in communication with a gear port at a time and to have the discharge timing port communicate with a gear port during the occurrence of a pressure pulse and terminate at the time of a pressure peak in the pulsed flow.

10. A fuel pump for delivering pulsed fuel flow to a nozzle of an atomization burner comprising, a pump housing, a pair of rotatable gears within said housing including an externally-toothed inner gear and a surrounding internally-toothed ring gear which together rotate between an arcuate fluid inlet port and an arcuate pressure port and in association with a crescent member deliver pressurized fluid to the pressure port with a pressure pulse each time a tooth of the inner gear makes full penetration into the space between a pair of teeth of the ring gear, a pump outlet, an elongate passage in said pump housing at least partially spanning said inlet and pressure ports and at a greater distance from an axis of rotation of the inner gear and communicating with said pump outlet, a series of gear ports each extending through the ring gear and radially outward from the space between a pair of teeth of said ring gear, a discharge timing port and a dump timing port in said pump housing extending between the outer periphery of the ring gear and said elongate passage, said timing ports being positioned to have only one timing port in communication with a gear port at a time and to have the discharge timing port communicate with a gear port when a pressure pulse occurs in a fixed frequency relation and thereafter, as said communication stops, a gear port moves into communication with the dump timing port.

11. A fuel pump as defined in claim 10 wherein the gear ports of the series are positioned to open to said discharge timing port on every third pressure pulse.

12. A pump as defined in claim 10 including means operable at variable speeds for driving one of said rotatable gears, and means for varying the speed of the last-mentioned means to control the rate of fuel supplied to the nozzle without varying said fixed frequency relation.

13. A system as defined in claim 12 including a combustion air supply mechanism for supplying combustion air to said nozzle, and means for driving said mechanism at the same speed as said pump whereby air flow and fuel flow rates have a ratio for good fuel combustion.

14. A pump as defined in claim 10 wherein said timing ports have a width in the direction of travel of the ring gear which is greater than the width of each of the gear ports.

15. A pump as defined in claim 10 wherein the trailing edge of the discharge timing port is positioned to discontinue communication with a gear port immediately after the occurrence of a pressure pulse.

* * * * *